US007638996B2

(12) United States Patent
Sugimura et al.

(10) Patent No.: US 7,638,996 B2
(45) Date of Patent: Dec. 29, 2009

(54) REFERENCE CURRENT GENERATOR CIRCUIT

(75) Inventors: Naoaki Sugimura, Tokyo (JP); Danya Sugai, Tokyo (JP)

(73) Assignee: Oki Semiconductor Co., Ltd., Tokyo (JP)

( * ) Notice: Subject to any disclaimer, the term of this patent is extended or adjusted under 35 U.S.C. 154(b) by 124 days.

(21) Appl. No.: 11/848,315

(22) Filed: Aug. 31, 2007

(65) Prior Publication Data

US 2008/0094050 A1 Apr. 24, 2008

(30) Foreign Application Priority Data

Oct. 19, 2006 (JP) ..... 2006-284745

(51) Int. Cl.
*G05F 3/16* (2006.01)
*G05F 1/10* (2006.01)

(52) U.S. Cl. ..... 323/316; 323/313; 327/539

(58) Field of Classification Search ..... 323/312–317, 323/907; 327/538, 539, 543
See application file for complete search history.

(56) References Cited

U.S. PATENT DOCUMENTS 5,136,182 A * 8/1992 Fawal ..... 327/541
5,686,825 A * 11/1997 Suh et al. ..... 323/316
6,717,878 B2 * 4/2004 Hagura et al. ..... 365/211
6,906,581 B2 * 6/2005 Kang et al. ..... 327/539
7,309,978 B2 * 12/2007 Ku et al. ..... 323/316

FOREIGN PATENT DOCUMENTS

JP 2000-075947 3/2000
JP 2003-131749 5/2003

OTHER PUBLICATIONS

Hironori Banba et al, "A CMOS Bandgap Reference Circuit with Sub-1-V Operation," 1999 IEEE Journal of Solid-State Circuits, vol. 34, No. 5, May 1999, pp. 670-674.

* cited by examiner

*Primary Examiner*—Matthew V Nguyen
(74) *Attorney, Agent, or Firm*—Volentine & Whitt, P.L.L.C.

(57) ABSTRACT

A reference current generator circuit that suppresses variations in the production of parts and attains a voltage reduction, thereby suppressing power consumption. The reference current generator circuit includes current generating circuit parts, differential amplifying circuit parts, output circuit parts that output first and second reference currents respectively, and a resistor for converting a reference current to a reference voltage. Since respective voltages are kept at the same potential, respective PMOSs are operated in a linear region by means of the differential amplifying circuit pads.

12 Claims, 3 Drawing Sheets

REFERENCE CURRENT GENERATOR CIRCUIT

BACKGROUND OF THE INVENTION

The present invention relates to a reference current generator circuit that generates a reference current for generating a reference voltage, and particularly to a circuit configuration for performing an operation at a low voltage.

As an example of a reference voltage generator circuit for generating a reference voltage free of temperature dependence, there has heretofore been known one described in a patent document 1 (Japanese Unexamined Patent Publication No. 2003-131749).

The present patent document 1 has described a reference voltage generator circuit using a bandgap reference voltage circuit, which reduces a through current by reliably starting up at power-on and reduces power consumption by the reduction in the through current.

As examples of reference current generator circuits for generating reference voltages, there have been known ones described in, for example, a patent document 2 (Japanese Unexamined Patent Publication No. 2000-75947) and a non-patent document 1 (Hironori Banda, Hitoshi Shiga, Akira Umezawa, Takeshi Miyaba, Toru Tanzawa, Shigeru Atsumi and Koji Sakui, "A CMOS Bandgap Reference Circuit with Sub-1-V Operation", fifth edition, Vol. No. 34 (U.S.A), IEEE Journal of Solid-State Circuits, May 1999, p. 670-674).

FIG. 2 is a schematic circuit diagram showing a configuration example of the conventional reference current generator circuit described in each of the patent document 1 and the non-patent document 1 or the like.

The reference current generator circuit is inputted with a source voltage Vcc and comprises a current generating circuit section or part 10, a differential amplifying circuit section or part 20 which generates a control voltage from a forward voltage Vd and a voltage Vt, and an output circuit section or part 30 which converts a reference current Iref into a reference voltage Vref and outputs it therefrom.

In the current generating circuit part 10, an enhancement P channel type MOS transistor (hereinafter called "PMOS") 11 and a diode 12 are connected in series between a source voltage terminal VCC and a ground terminal GND. And a resistor 13 is connected in parallel with the diode 12 via an output node VD. Further, a PMOS 14, a resistor 15 and a diode circuit section or part 16 are connected in series between the source voltage terminal VCC and the ground terminal GND. And a resistor 17 is connected in parallel with the series-connected resistor 15 and diode circuit part 16 via an output node VT. The diode circuit part 16 comprises n diodes 16*a*connected in parallel.

The differential amplifying circuit part 20 has a differential amplifying circuit 21 provided between the source voltage terminal VCC and the ground terminal GND, which is connected to the output nodes VD and VT and outputs a control voltage Vc to the gates of the PMOSs 11 and 14. Further, a PMOS 22 of which the gate is inputted with a control voltage Vc, and a diode-connected enhancement N channel type MOS transistor (hereinafter called "NMOS") 23 are connected in series between the source voltage terminal VCC and the ground terminal GND. A capacitor 24 for stable operation is connected to its corresponding input terminal of the differential amplifying circuit 21 connected to the output node VD.

The differential amplifying circuit 21 has a current mirror circuit constituted of PMOSs 21*a* and 21*b*, a depletion N channel type MOS transistor (hereinafter called "DNMOS") 21*c* connected to the output node VT and the PMOS 21*b*, a DNMOS 21*d* which is connected to the output node VD and the PMOS 21*b* and outputs the control voltage Vc, and an NMOS 21*e* which is connected between the DNMOSs 21*c* and 21*d* and the ground terminal GND and constitutes a current mirror circuit together with the NMOS 23.

The output circuit part 30 includes a capacitor 31 for stable operation provided between the source voltage terminal VCC and the collector of the DNMOS 21*d* corresponding to an output terminal of the differential amplifying circuit 21, a PMOS 32 which is inputted with the control voltage Vc and thereby causes a reference current Iref to flow, an NMOS 33 which forcedly short-circuits the gates of the PMOSs 11, 14, 22 and 32 with the ground terminal GND when a control signal PONRST is in an on state, and a resistor 34 which converts the reference current Iref to a reference voltage Vref.

The operation of the conventional reference current generator circuit shown in FIG. 2 will next be explained.

A forward voltage Vd outputted from the output node VD and a voltage Vt outputted from the output node VT are inputted. In doing so, the differential amplifying circuit part 20 is operated so as to keep the forward voltage Vd and the voltage Vt at the same potential by an imaginary short circuit.

Since the forward voltage Vd and the voltage Vt are of the same potential, a source voltage Vcc is commonly applied to the sources of the PMOSs 11, 14 and 32, and a control voltage is commonly applied to the gates thereof. Assume that the sizes of channel widths W and channel lengths L of the PMOSs 11, 14 and 32 are identical and they are respectively being operated in a saturated region. When currents that flow through the PMOS 11, PMOS 14 and PMOS 32 are respectively defined as Ids11, Ids14 and Ids32, the currents Ids11, Ids14 and Ids32 become equal to one another.

Assuming now that the resistance value of the resistor 13 is R13, the resistance value of the resistor 17 is R17 and the resistance values R13 and R17 are exactly the same, the forward voltage Vd=Vt, the current Ids11=Ids14 and the resistance value R13=R17 are established. Therefore, the currents that flow through the resistors 13 and 17 become equal to each other, and the currents that flow through the diode 12 and the diode circuit part 16 become also identical to each other. Assuming that the current that flows through each of the diode 12 and the diode circuit part 16, is defined as Ids1, the Boltzmann constant is defined K, the ambient temperature is defined as T, the electric charge is defined as q, and the saturation current of the diode 12 is defined as Is, a voltage Vd12 applied to the diode 12 can be expressed in the following equation:

$$Vd12=KT/q\times LN(Ids1/Is) \tag{1}$$

Since the number of the diodes 16*a* connected in parallel is n, a current ratio flowing through each diode, per diode becomes 1:1/n. Thus, a voltage Vd16 applied to the diode circuit part 16 can be expressed in the following equation:

$$Vd16=KT/q\times LN(Ids1/n\times Is) \tag{2}$$

Further, a voltage V15 applied across the resistor 15 can be expressed in the following equation:

$$V15=Vd12-Vd16=KT/q\times LN(n) \tag{3}$$

Assuming that the resistance value of the resistor 15 is R15, the voltage applied across the resistor 15 is V15, and the current flowing through the resistor 15 at this time is Ids1, the current Ids1 can be expressed in the following equation:

$$Ids1=V15/R15=(1/R15)\times KT/q\times LN(n) \tag{4}$$

Assume now that the current flowing through the resistor 17 is Ids2. Since the voltages Vd12=Vd16 and the resistance values R13=R17, the current Ids2 can be expressed in the following equation:

$$\begin{aligned} Ids2 &= Vd16/R17 \\ &= Vd12/R13 \\ &= (1/R13)\times KT/q\times \mathrm{LN}(Ids1/Is) \end{aligned} \tag{5}$$

Thus, currents Ids11, 14 and 32 can be expressed in the following equation:

$$Ids11=Ids14=Ids32=Ids1+Ids2$$

Assuming that the resistance value of the resistor 34 is R34, a reference voltage Vref can be expressed in the following equation in accordance with the equation (5):

$$\begin{aligned} Vref &= R34\times(Ids32) \\ &= R34\times(Ids1+Ids2) \\ &= (R34/R13)\times\left[\begin{matrix} Vd12+R13/R15\times \\ KT/q\times \mathrm{LN}(n) \end{matrix}\right] \end{aligned} \tag{6}$$

Thus, the conventional reference current generator circuit generates the reference current Iref by the PMOS 32 and allows the reference current Iref to flow through the load resistor 34 connected to the PMOS 32, thereby generating a constant reference voltage Vref free of temperature dependence from a reference voltage output terminal VREF.

However, the conventional reference current generator circuit was accompanied by such problems as described in the following (a) through (c).

(a) The equation (6) is not established unless R13=R17. That is, the conventional reference current generator circuit is of a circuit affected by variations in the production of the resistors 13 and 17.

(b) The PMOSs 11, 14 and 32 respectively need to be operated in the saturated region. Further, since the forward voltage Vd and the voltage Vt are determined depending upon diode characteristics, it is difficult to attain a reduction in voltage.

(c) In order to attain the voltage reduction, the channel widths W and channel lengths L of the PMOSs 11, 14 and 32, and the sizes of the diodes 12 and 16*a* are enlarged and the amounts of current are increased, whereby their operating voltages are reduced. However, demerits like an increase in chip size and an increase in current consumption occur. Since the characteristics of the PMOSs 11, 14 and 32 are determined depending on the process as the case may be, it is difficult to attain the reduction in voltage by circuit design.

SUMMARY OF THE INVENTION

With the foregoing in view, it is an object of the present invention to provide a reference current generator circuit capable of suppressing variations in the manufacture of parts and attaining a reduction in voltage, thereby suppressing power consumption.

In order to attain the above object, there is provided a reference current generator circuit according to the present invention, including an output circuit part which outputs a first voltage $V_1$ and a first reference current Iref1 respectively corresponding to a first current $I_1$ having a temperature coefficient positive for an ambient temperature T, and a second voltage $V_2$ and a second reference current Iref2 respectively corresponding to a second current $I_2$ having a temperature coefficient negative for the ambient temperature T.

Further, the reference current generator circuit of the present invention includes control means which is inputted with a forward voltage Vd, a voltage Vt, a voltage Vr, and the first and second voltages $V_1$ and $V_2$ and generates control voltages corresponding to a difference between the forward voltage Vd and the voltage Vt, a difference between the voltage Vt and the first voltage $V_1$, a difference between the forward voltage Vd and the voltage Vr, and a difference between the voltage Vr and the second voltage $V_2$, and which controls the first current $I_1$ and the second current $I_2$ by the control voltages in such a manner that the voltages Vd, Vt, Vr, $V_1$ and $V_2$ inputted by an imaginary short circuit are kept at the same potential, and output means which combines the first reference current Iref1 and the second reference current Iref2 with each other and outputs a combination thereof as a third reference current Iref having a temperature dependent characteristic and capable of adjusting a current value thereof.

According to the reference current generator circuit of the present invention, there is provided control means for controlling a first current $I_1$ and a second current $I_2$ in such a manner that voltages Vd, Vt and Vr are kept at the same potential. Therefore, the value of a third reference current Iref can be adjusted by adjusting the resistance value of second resistance means. Further, since the control means for controlling the first current $I_1$ and the second current $I_2$ in such a manner that the voltages Vd, Vt, Vr, $V_1$ and $V_2$ are kept as the same potential, is provided, a reduction in potential/source voltage is enabled, thus making it possible to suppress power consumption.

BRIEF DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

DETAILED DESCRIPTION OF THE PREFERRED EMBODIMENTS

A forward voltage Vd and a voltage Vt are utilized in combination. There are provided a first current generating circuit section or part; a second current generating circuit section or part; an output circuit section or part which outputs a first voltage $V_1$ and a first reference current Iref1 respectively corresponding to a first current $I_1$, and a second voltage $V_2$ and a second reference current Iref2 respectively corresponding to a second current $I_2$; control means which controls the first current $I_1$ and the second current $I_2$ by control voltages in such a manner that the voltages Vd, Vt, Vr, $V_1$ and $V_2$ are kept at the same potential; and output means which combines the first reference current Iref1 and the second reference current Iref2 with each other and outputs a combination thereof as a third reference current Iref having a temperature dependent characteristic and capable of adjusting a current value thereof.

The control means includes a two-input/one-output type first amplifying circuit section or part which is inputted with the forward voltage Vd and the voltage Vt and generates a first control voltage in accordance with the difference between the inputted voltages and which controls the first current $I_1$ by the first control voltage in such a manner that the forward voltage Vd and the voltage Vt are kept at the same potential, and a two-input/one-output type second amplifying circuit section or part which is inputted with the voltage Vt and the first voltage $V_1$ and generates a second control voltage in accordance with the difference between the inputted voltages and which controls the first current $I_1$ by the second control voltage in such a manner that the voltage Vt and the first voltage $V_1$ are kept at the same potential.

Further, the control means includes a two-input/one-output type third amplifying circuit section or part which is inputted with the forward voltage Vd and the voltage Vr and generates a third control voltage in accordance with the difference between the inputted voltages and which controls the second current $I_2$ by the third control voltage in such a manner that the forward voltage Vd and the voltage Vr are kept at the same potential, and a two-input/one-output type fourth amplifying circuit section or part which is inputted with the voltage Vt and the second voltage $V_2$ and generates a fourth control voltage in accordance with the difference between the inputted voltages and which controls the second current $I_2$ by the fourth control voltage in such a manner that the voltage Vt and the second voltage $V_2$ are kept at the same potential.

Preferred embodiments of the present invention will hereinafter be described with reference to the accompanying drawings.

First Preferred Embodiment (Configuration of First Embodiment)

Figure 1:
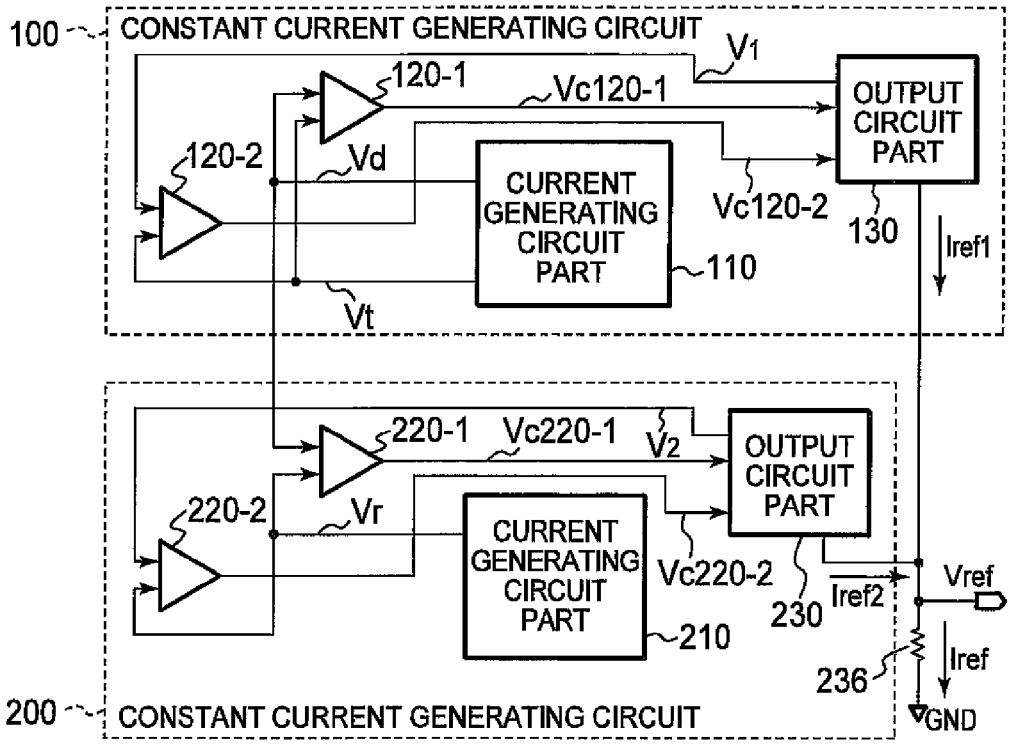
FIG. 1 is a block diagram showing a configuration example of a reference current generator circuit according to a first embodiment of the present invention.
Figure 2:
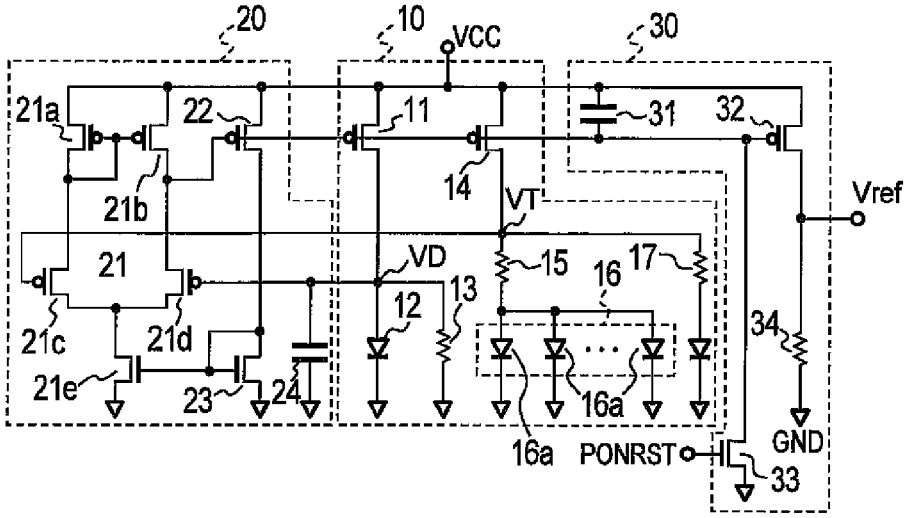
FIG. 2 PRIOR ART
FIG. 2 is a schematic circuit diagram illustrating a configuration example of a conventional reference current generator circuit.

FIG. 1 is a block diagram showing a configuration example of a reference current generator circuit according to a first embodiment of the present invention.

The reference current generator circuit has a constant current generating circuit 100 which is inputted with a source voltage Vcc and outputs a first reference current Iref1 having a positive temperature coefficient and a forward voltage Vd, a constant current generating circuit 200 which is inputted with the source voltage Vcc and the forward voltage Vd therein and outputs a second reference current Iref2 having a negative temperature coefficient, and output means (e.g., resistor) 236 which has a temperature dependence characteristic and allows a third reference current Iref capable of adjusting a current value thereof to flow therethrough to convert it into a reference voltage Vref.

The constant current generating circuit 100 has a first current generating circuit section or part 110 which is inputted with a first current $I_1$ (e.g., current Ids1) having a temperature coefficient positive for an ambient temperature T and outputs the forward voltage Vd and a voltage Vt corresponding to the ambient temperature T, and a two-input/one-output type first amplifying circuit section or part (e.g., differential amplifying circuit section or part) 120-1 which is inputted with the forward voltage Vd and the voltage Vt and outputs a first control voltage Vc120-1 generated by amplifying the difference between the inputted forward voltage Vd and voltage Vt.

Further, the constant current generating circuit 100 includes a two-input/one-output type second amplifying circuit section or part (e.g., differential amplifying circuit section or part) 120-2 which is inputted with a first voltage $V_1$ corresponding to the voltage Vt and current Ids1 associated with the ambient temperature T and outputs a second control voltage Vc120-2 produced by amplifying the difference between the inputted voltage Vt and $V_1$, and an output circuit section or part 130 which is inputted with the control voltages Vc120-1 and Vc120-2 and outputs a reference current Iref1 corresponding to the current Ids1.

The constant current generating circuit 200 has a second current generating circuit section or part 210 which is inputted with a second current $I_2$ (e.g., current Ids2) having a temperature coefficient negative for the ambient temperature T and outputs a voltage Vr corresponding to the current Ids2, a two-input/one-output type third amplifying circuit section or part (e.g., differential amplifying circuit section or part) 220-1 which is inputted with the forward voltage Vd and the voltage Vr and outputs a third control voltage Vc220-1 generated by amplifying the difference between the inputted forward voltage Vd and voltage Vr, a two-input/one-output type fourth amplifying circuit section or part (e.g., differential amplifying circuit section or part) 220-2 which is inputted with the voltage Vr and a second voltage $V_2$ corresponding to the current Ids2 and outputs a fourth control voltage Vc220-2 generated by amplifying the difference between the voltages Vr and $V_2$, and an output circuit section or part 230 which is inputted with the control voltages Vc220-1 and Vc220-2 and outputs a reference current Iref2 corresponding to the current Ids2.

Figure 3:
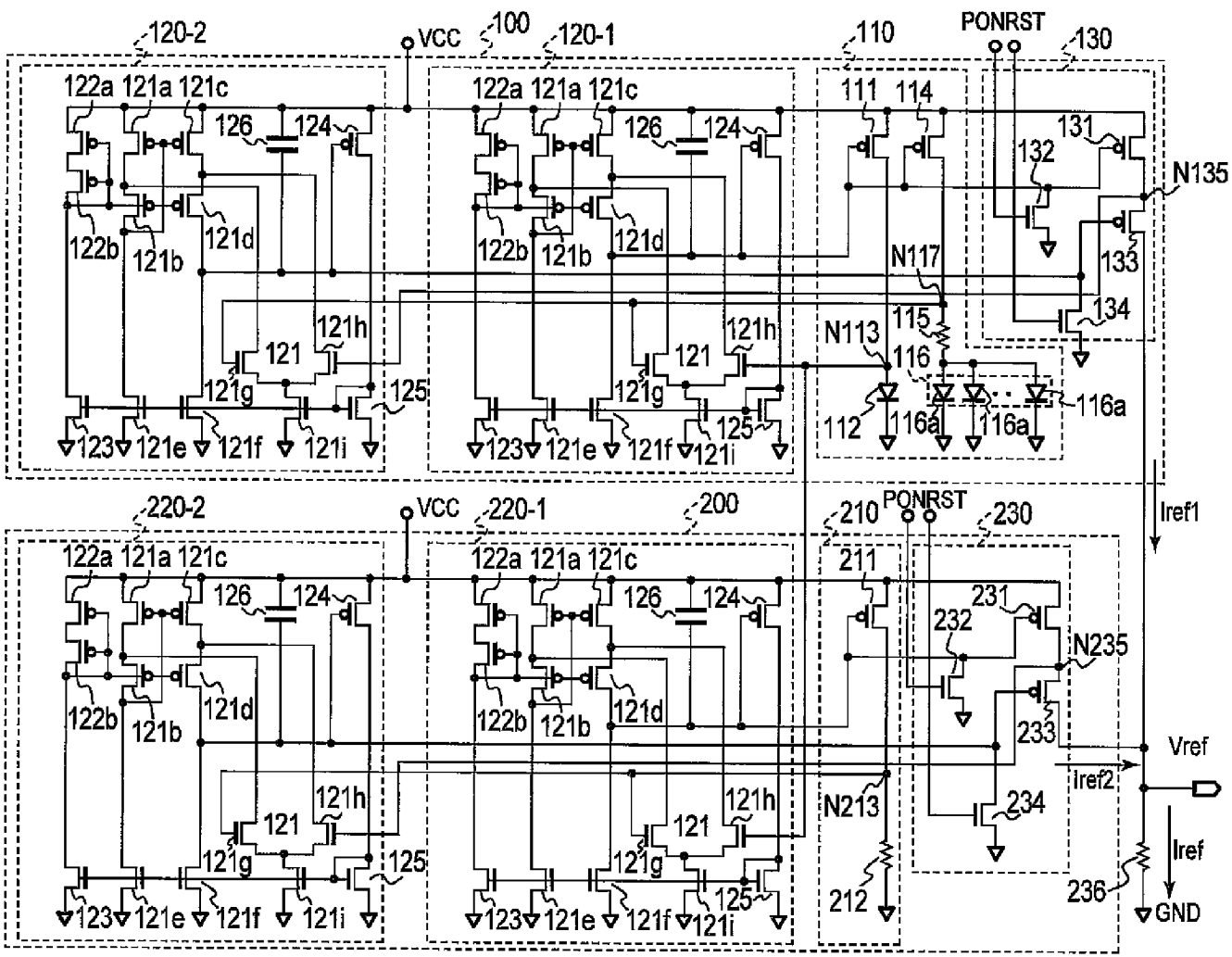
FIG. 3 is a schematic circuit diagram depicting the configuration example of the reference current generator circuit according to the first embodiment of the present invention.

FIG. 3 is a circuit diagram for describing the block diagram of FIG. 1 in detail.

The current generating circuit part 110 has a first current path and a second current path provided between a source voltage terminal VCC and a ground terminal GND. The first current path is made up of a PMOS 111 and a first diode 112 connected in series via an output node N113. The second current path is constituted of a PMOS 114 and a first resistance means (e.g., resistor) 115 connected in series via an output node N117. Further, the second current path has a diode circuit section or part 116 having n second diodes 116*a* connected in parallel, which is provided between the resistor 115 and the ground terminal GND.

The differential amplifying circuit part 120-1 has a differential amplifying circuit 121 which is connected to its corresponding output nodes N113 and N117 and outputs the control voltage Vc 120-1, PMOSs 122*a* and 122*b* connected in tandem between the source voltage terminal VCC and the ground terminal GND, and an NMOS 123 connected in series with the PMOS 122*b*. Further, the differential amplifying circuit part 120-1 includes a PMOS 124 whose gate is inputted with the control voltage Vc120-1 and a diode-connected NMOS 125 connected in series between the source voltage terminal VCC and the ground terminal GND, and a capacitor 126 for stable operation connected between the source voltage terminal VOC and the PMOS 124.

The differential amplifying circuit 121 includes a cascode-current mirror circuit constituted of PMOSs 121*a*, 121*b*, 121*c* and 121*d*, an NMOS 121*e* connected between the PMOS 121*b* and the ground terminal GND, an NMOS 121*f* connected between the PMOS 121*d* and the ground terminal GND, an NMOS 121*g* connected to the output node N117 and the PMOS 121*a*, an NMOS 121*h* connected to the output node N113 and the PMOS 121*c*, and an NMOS 121*i* which is connected between the NMOSs 121*g* and 121*h* and the ground terminal GND and constitutes a current mirror circuit together with the NMOSs 123, 121*e*, 121*f* and 125, and outputs the control voltage Vc120-1.

The differential amplifying circuit part 120-2 has an NMOS 121*h* connected to an output node N135 in place of the output node N113 and outputs the control voltage Vc120-2 therefrom. Since the differential amplifying circuit part 120-2 is identical in other configuration to the differential amplifying circuit part 120-1, its explanations are omitted and common symbols are attached to other constituent portions.

The first output circuit part 130 includes a first MOS transistor (e.g., PMOS) 131 which is inputted with the control voltage Vc120-1 and allows the first reference current Iref1 to flow therethrough when it is in a circuit operating state, an NMOS 132 which forcedly short-circuits the gates of the PMOSs 111, 114, 131 and PMOS 124 of the differential amplifying circuit part 120-1 with the ground terminal GND when a control signal PONRST is in an on state, a second MOS transistor (e.g., PMOS) 133 which is inputted with the control voltage Vc120-2 and which causes the reference current Iref1 to flow when it is in the circuit operating state, and an NMOS 134 which forcedly short-circuits the gates of both PMOS 133, and PMOS 124 of the differential amplifying circuit part 120-2 with the ground terminal GND. The PMOSs 131 and 133 are connected in series via the output node N135 from which the first voltage $V_1$ is outputted, and constitute a third current path.

The current generating circuit part 210 has a PMOS 211 and a second resistance means (e.g., resistor) 212 series-connected thereto via an output node N213, both of which are provided between the source voltage terminal VCC and the ground terminal GND, and constitutes a fourth current path.

The differential amplifying circuit part 220-1 has an NMOS 121*g* connected to an output node N213 in place of the output node N117 and, an NRAOS 121*h* connected to the N113 and outputs the control voltage Vc220-1 therefrom. Since the differential amplifying circuit part 220-1 is identical in other configuration to the differential amplifying circuit part 120-1, its explanations are omitted and common symbols are attached to other constituent portions.

The differential amplifying circuit part 220-2 has an NMOS 121*g* connected to an output node N213 in place of the output node N117, an NMOS 121*h* connected to an output node N235 in place of the output node N113, and outputs the control voltage Vc220-2 therefrom. Since the differential amplifying circuit part 220-2 is identical in other configuration to the differential amplifying circuit part 120-1, its explanations are omitted and common symbols are attached to other constituent portions.

The second output circuit part 230 includes a third MOS transistor (e.g., PMOS) 231 which is inputted with the control voltage Vc220-1 and allows the second reference current Iref2 to flow therethrough when it is in a circuit operating state, an NMOS 232 which forcedly short-circuits the gates of the PMOSs 211, 231, and PMOS 124 of the differential amplifying circuit part 220-1 with the ground terminal GND when a control signal PONRST is in an on state, a fourth transistor (e.g., PMOS) 233 which is inputted with the control voltage Vc220-2 and causes the reference current Iref2 to flow when it is in the circuit operating state, and an NMOS 234 which forcedly short-circuits the gates of both PMOS 233, and PMOS 124 of the differential amplifying circuit part 220-2 with the ground terminal GND. The PMOSs 231 and 233 are connected in series via the output node N235 from which the second voltage $V_2$ is outputted, and constitute a fifth current path.

(Operation of First Embodiment)

In the constant current generating circuit 100 shown in FIGS. 1 and 3, the source voltage Vcc is commonly applied to the sources of the PMOSs 111, 114 and 131, and the control voltage Vc120-1 is commonly applied to their gates. Further, since the forward voltage Vd, voltage Vt and voltage $V_1$ become equal to one another by the differential amplifying circuit parts 120-1 and 120-2 when the sizes of channel widths W and channel lengths L of the PMOSs 111, 114 and 131 are all identical, each voltage Vds1 applied to the PMOSs 111, 114 and 131 becomes also equal to each other. Thus, even though the PMOSs 111, 114 and 131 are operated in a linear region, each current Ids1 flowing through these PMOSs becomes equal to each other. Assuming at this time that the resistance value of the resistor 115 is R115 and the number of the diodes that constitute the diode circuit part 116 is n, the current Ids1 can be expressed in the following equation:

$$Ids1=(1/R115)\times[KT/q\times LN(n)] \tag{7}$$

Further, in a manner similar to the above even in the case of the constant current generating circuit 200, the source voltage Vcc is commonly applied to the sources of the PMOSs 211 and 231, and the control voltage Vc220-1 is commonly applied to their gates. Further, since the forward voltage Vd, voltage Vr and voltage $V_2$ become equal by the differential amplifying circuit parts 220-1 and 220-2 when the sizes of channel widths W and channel lengths L of the PMOSs 211 and 231 are all identical, each voltage Vds2 applied to the PMOSs 211 and 231 becomes also equal to each other. Thus, even though the PMOSs 211 and 231 are operated in a linear region, each current Ids2 flowing through these PMOSs becomes equal to each other. Assuming at this time that the resistance value of the resistor 212 is R212, the current Ids2 can be expressed in the following equation:

$$Ids2=(1/R212)\times Vd \tag{8}$$

Here, the reference current Iref that flows through the resistor 236 can be expressed in the following equation from the results of the equations (7) and (8):

$$\begin{aligned} Iref &= Iref1 + Iref2 \\ &= Ids1 + Ids2 \\ &= (1/R115)\times[KT/q\times \mathrm{LN}(n)] + (1/R212)\times Vd \\ &= (1/R212)\times\left\{\begin{matrix} Vd + R212/R115\times \\ [KT/q\times \mathrm{LN}(n)] \end{matrix}\right\} \end{aligned} \tag{9}$$

The reference current Iref is generated in proportional to 1/R212 having a temperature dependent characteristic from the equation (9).

At this time, the reference voltage Vref is expressed in the following equation assuming that the resistance value of the resistor 236 is R236:

$$\begin{aligned} Vref &= R236\times Iref \\ &= (R236/R212)\times\left\{\begin{matrix} Vd + R212/R115\times \\ [KT/q\times \mathrm{LN}(n)] \end{matrix}\right\} \end{aligned} \tag{10}$$

Thus, the reference voltage Vref free of temperature dependence can be generated.

(Advantageous Effects of First Embodiment)

According to the reference current generator circuit of the first embodiment, the following advantageous effects (a) through (c) are brought about since the voltages Vd, Vt, Vr, $V_1$ and $V_2$ are respectively kept at the same potential.

(a) The resistor for determining the current Ids2 is only the resistor 212. Therefore, although the reference current generator circuit according to the first embodiment is affected by variations in the manufacture of the resistor 212, this can be solved by trimming (which means that the surface of the resistor is cut by means of a laser beam or the like to thereby fine-adjust its resistance value) of the resistor 212.

(b) Since the PMOSs 111, 114, 131, 211 and 231 can be operated in the linear region, the source voltage Vcc can be reduced. This enables a reduction in power consumption.

(c) Since the reduction in the source voltage can be attained by the above (b), it is not necessary to increase the channel widths W and channel lengths L of the PMOSs 111, 114, 131, 211 and 231, and the sizes of the diodes 112 and 116*a*.

Second Preferred Embodiment (Configuration of Second Embodiment)

Figure 4:
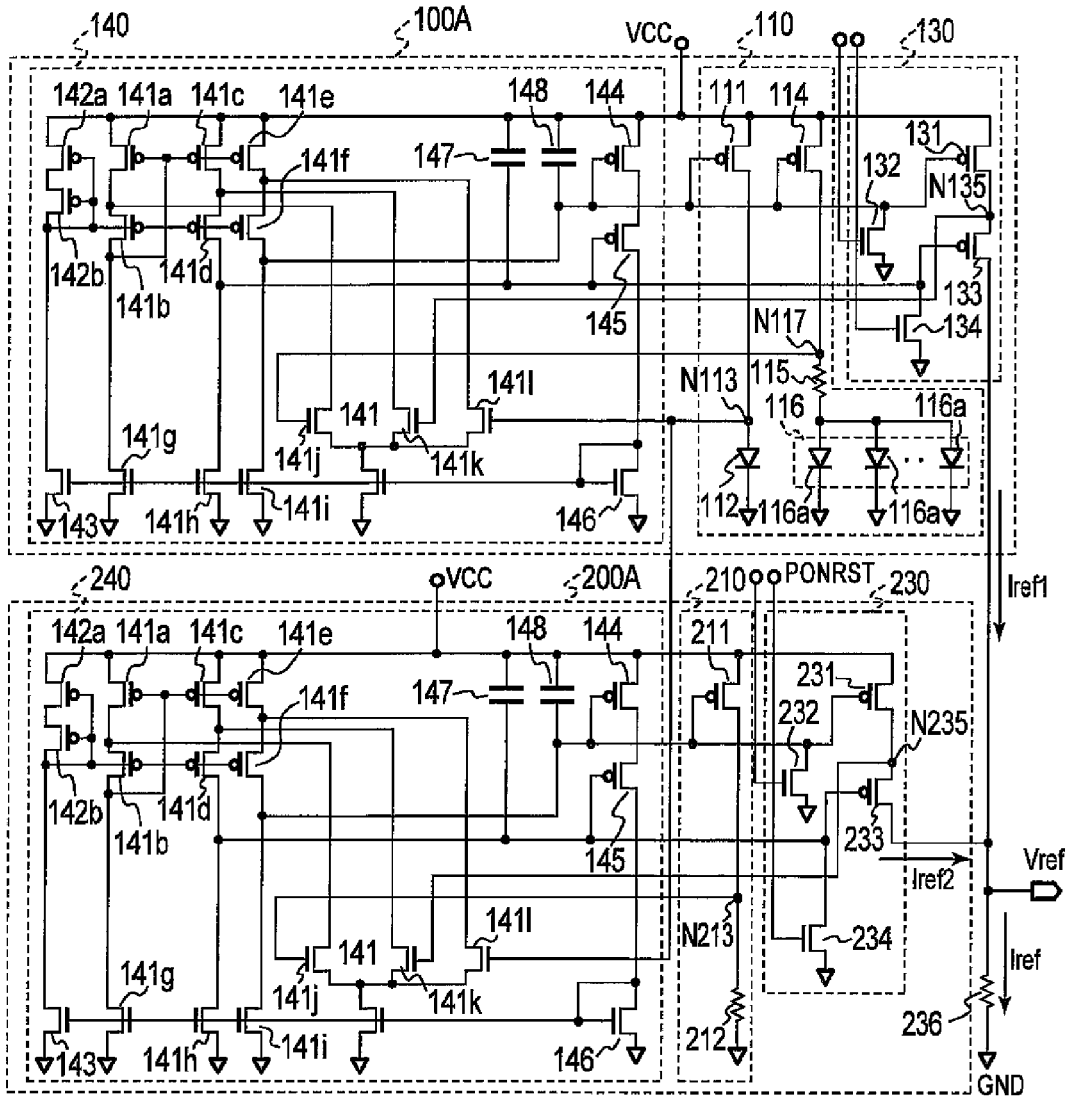
FIG. 4 is a schematic circuit diagram showing a configuration example of a reference current generator circuit according to a second embodiment of the present invention.

FIG. 4 is a schematic circuit diagram showing a configuration example of a reference current generator circuit according to a second embodiment of the present invention. Constituent elements common to those in FIG. 3 illustrative of the first embodiment are respectively given common symbols. The reference current generator circuit according to the second embodiment comprises a constant current generating circuit 100A different in configuration from the constant current generating circuit 100 of the first embodiment, a constant current generating circuit 200A different in configuration from the constant current generating circuit 200 of the first embodiment, and a resistor 236 similar to that of the first embodiment.

Unlike the constant current generating circuit 100 of the first embodiment, the constant current generating circuit 100A is provided with a three-input/two-output type fifth amplifying circuit section or part (e.g., differential amplifying circuit section or part) 140 in place of the differential amplifying circuit parts 120-1 and 120-2.

The differential amplifying circuit part 140 has a three-input/two-output type differential amplifying circuIt 141 which is connected to output nodes N113, N117 and N135 and outputs control voltages Vc140-1 and Vc140-2, PMOSs 142*a* and 142*b* cascade-connected between a source voltage terminal VCC and a ground terminal GND, and an NMOS 143 connected in series with the PMOS 142*b*.

Further, the differential amplifying circuit part 140 includes a PMOS 144 whose gate is inputted with the control voltage Vc140-1, a PMOS 145 whose gate is inputted with the control voltage Vc140-2, and a diode-connected NMOS 146, which are series-connected between the source voltage terminal VCC and the ground terminal GND. A capacitor 147 for stable operation is connected between the source voltage terminal VCC and the PMOS 145. Further, a capacitor 148 for stable operation is connected between the source voltage terminal VCC and the PMOS 144.

The differential amplifying circuit 141 includes a cascode-current mirror circuit constituted of PMOSs 141*a*, 141*b*, 141*c*, 141*d*, 141*e* and 141*f*, an NMOS 141*g* connected between the PMOS 141*b* and the ground terminal GND, an NMOS 141*h* connected between the PMOS 141*d* and the ground terminal GND, and an NMOS 141*i* connected between the PMOS 141*f* and the ground terminal GND.

Further, the differential amplifying circuit 141 includes an NMOS 141*j* connected to the output node N117 and the PMOS 141*a*, an NMOS 141*k* connected to the output node N135 and the PMOS 141*c*, an NMOS 141*l* connected to the output node N113 and the PMOS 141*e*, and an NMOS connected between the NMOS 141*j*, 141*k* and 141*l* and the ground terminal GND. Further, the differential amplifying circuit 141 has the NMOSs 143, 141*g*, 141*h*, 141*i* and 146, and an NMOS 141*m* that constitutes a current mirror circuit, and outputs the control voltages Vc140-1 and Vc140-2.

Unlike the constant current generating circuit 200 of the first embodiment, the constant current generating circuit 200A is provided with a three-input/two-output type sixth amplifying circuit section or part (e.g., differential amplifying circuit section or part) 240 in place of the differential amplifying circuit parts 220-1 and 220-2.

The differential amplifying circuit part 240 includes an NMOS 141*j* connected to an output node N213 in place of the output node N117. Further, the differential amplifying circuit part 240 has an NMOS 141*k* connected to an output node N235 in place of the output node N135 and outputs control voltages Vc240-1 and Vc240-2. Since the differential amplifying circuit part 240 is identical in other configuration to the differential amplifying circuit part 140, its explanations are omitted and common symbols are attached to other constituent portions.

(Operation of Second Embodiment)

In the constant current generating circuit 100A, a source voltage Vcc is commonly applied to the sources of PMOSs 111, 114 and 131, and the control voltage Vc140-1 is commonly applied to their gates. Further, since a forward voltage Vd, a voltage Vt and a voltage V, become equal to one another by the differential amplifying circuit part 140 when the sizes of channel widths W and channel lengths L of the PMOSs 111, 114 and 131 are all identical, each voltage Vds1 applied to the PMOSs 111, 114 and 131 becomes also equal to each other. Thus, even though the PMOSs 111, 114 and 131 are operated in a linear region, each current Ids1 flowing through these PMOSs becomes equal to each other. Assuming at this time that the resistance value of a resistor 115 is R115 and the number of diodes that constitute a diode circuit section or part 116 is n, the current Ids1 can be expressed in the following equation:

$$Ids1=(1/R115)\times[KT/q\times LN(n)] \quad (11)$$

Further, in a manner similar to the above even in the case of the constant current generating circuit 200A, the source voltage Vcc is commonly applied to the sources of PMOSs 211 and 231, and the control voltage Vc240-1 is commonly applied to their gates. Since the forward voltage Vd, voltage Vr and voltage $V_2$ become equal by the differential amplifying circuit part 240 when the sizes of channel widths W and channel lengths L of the PMOSs 211 and 231 are all identical, each voltage Vds2 applied to the PMOSs 211 and 231 becomes also equal to each other. Thus, even though the PMOSs 211 and 231 are operated in a linear region, each current Ids2 flowing through these PMOSs becomes equal to each other. Assuming at this time that the resistance value of a resistor 212 is R212, the current Ids2 can be expressed in the following equation:

$$Ids2=(1/R212)\times Vd \quad (12)$$

Here, a reference current Iref that flows through the resistor 236 can be expressed in the following equation from the results of the equations (11) and (12):

$$Iref = Iref1 + Iref2 \quad (13)$$
$$= Ids1 + Ids2$$
$$= (1/R115) \times [KT/q \times \mathrm{LN}(n)] + (1/R212) \times Vd$$
$$= (1/R212) \times \left\{ \begin{matrix} Vd + R212/R115 \times \\ [KT/q \times \mathrm{LN}(n)] \end{matrix} \right\}$$

The reference current proportional to 1/R212 having a temperature dependent characteristic is generated from the equation (13).

At this time, a reference voltage Vref is expressed in the following equation assuming that the resistance value of the resistor 236 is R236:

$$Vref = R236 \times Iref \quad (14)$$
$$= (R236/R212) \times \left\{ \begin{matrix} Vd + R212/R115 \times \\ [KT/q \times \mathrm{LN}(n)] \end{matrix} \right\}$$

Thus, the reference voltage Vref free of temperature dependence in a manner similar to the first embodiment can be generated.

(Advantageous Effects of Second Embodiment)

According to the reference current generator circuit of the second embodiment, advantageous effects similar to the first embodiment are brought about by using the three-input/two-output type differential amplifying circuit parts 140 and 240 in place of the differential amplifying circuit parts 120-1, 120-2, 220-1 and 220-2. Further, the layout area can be narrowed as compared with the first embodiment, and the number of parts is reduced, thus making it possible to suppress power consumption.

Preferred Modifications

The present invention is not limited to the first and second embodiments referred to above. Various use forms and modifications can be made thereto. As the usage forms and modifications, may be mentioned, for example, the following ones (A) through (G).

(A) Although the current generating circuit part 110 is configured by the diode 112 in each of the first and second embodiments, it may be constituted of a diode-connected bipolar transistor or the like.

(B) Although the diode circuit part 116 is configured by the diodes 116*a* in each of the first and second embodiments, it may be constituted of a diode-connected bipolar transistor or the like.

(C) Although the differential amplifying circuit parts constituted of PMOSs and NMOSs are configured in combination in each of the first and second embodiments, the circuit parts may be combined using operational amplifiers or the like.

(D) In the first embodiment, such a configuration that the gate of the NMOS 121*h* of the differential amplifying circuit part 220-1 and the anode of each diode 116*a* are connected, may be taken.

(E) In the first embodiment, such a configuration that the gate of the NMOS 121*h* of the differential amplifying circuit part 220-1 and the node N117 are connected, may be taken.

(F) In the second embodiment, such a configuration that the gate of the NMOS 141*l* of the three-input/two-output type differential amplifying circuit part 240 and the anode of each diode 116*a* are connected, may be taken.

(G) In the second embodiment, such a configuration that the gate of the NMOS 141*l* of the three-input/two-output type differential amplifying circuit part 240 and the node N117 are connected, may be taken.

What is claimed is:

1. A reference current generator circuit comprising:

a first current generating circuit part which generates a first current $I_1$ having a temperature coefficient positive for an ambient temperature T;

a second current generating circuit part which generates a second current $I_2$ having a temperature coefficient negative for the ambient temperature T;

an output circuit part which outputs a first voltage $V_1$ and a first reference current Iref1 respectively corresponding to the first current $I_1$, and a second voltage $V_2$ and a second reference current Iref2 respectively corresponding to the second current $I_2$;

control means which is inputted with a forward voltage Vd, a voltage Vt, a voltage Vr, and the first and second voltages $V_1$ and $V_2$ and generates control voltages corresponding to a difference between the forward voltage Vd and the voltage Vt, a difference between the voltage Vt and the first voltage $V_1$, a difference between the forward voltage Vd and the voltage Vr, and a difference between the voltage Vr and the second voltage $V_2$, and which controls the first current $I_1$ and the second current $I_1$ by the control voltages in such a manner that the inputted voltages Vd, Vt, Vr, $V_1$ and $V_2$ are kept at the same potential; and output means which combines the first reference current Iref1 and the second reference current Iref2 with each other and outputs a combination thereof as a third reference current Iref having a temperature dependent characteristic and capable of adjusting a current value thereof.

2. The reference current generator circuit according to claim 1, wherein the first current generating circuit part includes a first diode which is inputted with the first current $I_1$ having the temperature coefficient positive for the ambient temperature T and outputs the forward voltage Vd, first resistance means which is inputted with the first current $I_1$ and outputs the voltage Vt corresponding to the ambient temperature T, and a second diode connected in series with the first resistance means.

3. The reference current generator circuit according to claim 1, wherein the control means includes:

a two-input/one-output type first amplifying circuit part which is inputted with the forward voltage Vd and the voltage Vt and generates a first control voltage in accordance with the difference between the inputted voltages and which controls the first current $I_1$ by the first control voltage in such a manner that the forward voltage Vd and the voltage Vt are kept at the same potential, a two-input/one-output type second amplifying circuit part which is inputted with the voltage Vt and the first voltage $V_1$ and generates a second control voltage in accordance with the difference between the inputted voltages and which controls the first current $I_1$ by the second control voltage in such a manner that the voltage Vt and the first voltage $V_1$ are kept at the same potential, a two-input/one-output type third amplifying circuit part which is inputted with the forward voltage Vd and the voltage Vr and generates a third control voltage in accordance with the difference between the inputted voltages and which controls the second current $I_2$ by the third control voltage in such a manner that the forward voltage Vd and the voltage Vr are kept at the same potential, and a two-input/one-output type fourth amplifying circuit part which is inputted with the voltage Vt and the second voltage $V_2$ and generates a fourth control voltage in accordance with the difference between the inputted voltages and which controls the second current $I_2$ by the fourth control voltage in such a manner that the voltage Vt and the second voltage $V_2$ are kept at the same potential.

4. The reference current generator circuit according to claim 2, wherein the control means includes:

a two-input/one-output type first amplifying circuit part which is inputted with the forward voltage Vd and the voltage Vt and generates a first control voltage in accordance with the difference between the inputted voltages and which controls the first current $I_1$ by the first control voltage in such a manner that the forward voltage Vd and the voltage Vt are kept at the same potential, a two-input/one-output type second amplifying circuit part which is inputted with the voltage Vt and the first voltage $V_1$ and generates a second control voltage in accordance with the difference between the inputted voltages and which controls the first current $I_1$ by the second control voltage in such a manner that the voltage Vt and the first voltage $V_1$ are kept at the same potential, a two-input/one-output type third amplifying circuit part which is inputted with the forward voltage Vd and the voltage Vr and generates a third control voltage in accordance with the difference between the inputted voltages and which controls the second current $I_2$ by the third control voltage in such a manner that the forward voltage Vd and the voltage Vr are kept at the same potential, and a two-input/one-output type fourth amplifying circuit part which is inputted with the voltage Vt and the second voltage $V_2$ and generates a fourth control voltage in accordance with the difference between the inputted voltages and which controls the second current $I_2$ by the fourth control voltage in such a manner that the voltage Vt and the second voltage $V_2$ are kept at the same potential.

5. The reference current generator circuit according to claim 1, wherein the control means includes:

a three-input/two-output type fifth amplifying circuit part which is inputted with the forward voltage Vd, the voltage Vt and the first voltage $V_1$ and generates a first control voltage in accordance with the difference between the forward voltage Vd and the voltage Vt and generates a second control voltage in accordance with the difference between the inputted voltage Vt and first voltage $V_1$ and which controls the first current $I_1$ by the first and second control voltages in such a manner that the forward voltage Vd, the voltage Vt and the first voltage $V_1$ are kept at the same potential, and a three-input/two-output type sixth amplifying circuit part which is inputted with the forward voltage Vd, the voltage Vr and the second voltage $V_2$ and generates a third control voltage in accordance with the difference between the forward voltage Vd and the voltage Vr and generates a fourth control voltage in accordance with the difference between the inputted voltage Vr and second voltage $V_2$ and which controls the second current $I_2$ by the third and fourth control voltages in such a manner that the forward voltage Vd, the voltage Vr and the second voltage $V_2$ are kept at the same potential.

6. The reference current generator circuit according to claim 2, wherein the control means includes:

a three-input/two-output type fifth amplifying circuit part which is inputted with the forward voltage Vd, the voltage Vt and the first voltage $V_1$ and generates a first control voltage in accordance with the difference between the forward voltage Vd and the voltage Vt and generates a second control voltage in accordance with the difference between the inputted voltage Vt and first voltage $V_1$ and which controls the first current $I_1$ by the first and second control voltages in such a manner that the forward voltage Vd, the voltage Vt and the first voltage $V_1$ are kept at the same potential, and a three-input/two-output type sixth amplifying circuit part which is inputted with the forward voltage Vd, the voltage Vr and the second voltage $V_2$ and generates a third control voltage in accordance with the difference between the forward voltage Vd and the voltage Vr and generates a fourth control voltage in accordance with the difference between the inputted voltage Vr and second voltage $V_2$ and which controls the second current $I_2$ by the third and fourth control voltages in such a manner that the forward voltage Vd, the voltage Vr and the second voltage $V_2$ are kept at the same potential.

7. The reference current generator circuit according to claim 1, wherein the output circuit part comprises:

a first output circuit having a first MOS transistor which is inputted with the first current $I_1$ and outputs a first voltage $V_1$ and a first reference current Iref1 corresponding to the first current $I_1$ and which is operated by the first control voltage, and a second MOS transistor which is connected in series with the first MOS transistor and operated by the second control voltage, and a second output circuit having a third MOS transistor which is inputted with the second current $I_2$ and outputs a second voltage $V_2$ and a second reference current Iref2 corresponding to the second current $I_2$ and which is operated by the third control voltage, and a fourth MOS transistor which is connected in series with the third MOS transistor and operated by the fourth control voltage.

8. The reference current generator circuit according to claim 2, wherein the output circuit part comprises:

a first output circuit having a first MOS transistor which is inputted with the first current $I_1$ and outputs a first voltage $V_1$ and a first reference current Iref1 corresponding to the first current $I_1$ and which is operated by the first control voltage, and a second MOS transistor which is connected in series with the first MOS transistor and operated by the second control voltage, and a second output circuit having a third MOS transistor which is inputted with the second current $I_2$ and outputs a second voltage $V_2$ and a second reference current Iref2 corresponding to the second current $I_1$ and which is operated by the third control voltage, and a fourth MOS transistor which is connected in series with the third MOS transistor and operated by the fourth control voltage.

9. The reference current generator circuit according to claim 3, wherein the output circuit part comprises:

a first output circuit having a first MOS transistor which is inputted with the first current $I_1$ and outputs a first voltage $V_1$ and a first reference current Iref1 corresponding to the first current $I_1$ and which is operated by the first control voltage, and a second MOS transistor which is connected in series with the first MOS transistor and operated by the second control voltage, and a second output circuit having a third MOS transistor which is inputted with the second current $I_2$ and outputs a second voltage $V_2$ and a second reference current Iref2 corresponding to the second current $I_2$ and which is operated by the third control voltage, and a fourth MOS transistor which is connected in series with the third MOS transistor and operated by the fourth control voltage.

10. The reference current generator circuit according to claim 5, wherein the output circuit part comprises:

a first output circuit having a first MOS transistor which is inputted with the first current $I_1$ and outputs a first voltage $V_1$ and a first reference current Iref1 corresponding to the first current $I_1$ and which is operated by the first control voltage, and a second MOS transistor which is connected in series with the first MOS transistor and operated by the second control voltage, and a second output circuit having a third MOS transistor which is inputted with the second current $I_2$ and outputs a second voltage $V_2$ and a second reference current Iref2 corresponding to the second current $I_2$ and which is operated by the third control voltage, and a fourth MOS transistor which is connected in series with the third MOS transistor and operated by the fourth control voltage.

11. The reference current generator circuit according to claim 2, wherein the first resistance means is a resistive element whose resistance value is fixed.

12. The reference current generator circuit according to claim 2, wherein the first resistance means is a resistive element whose resistance value is variable by trimming.

* * * * *